US005635018A

United States Patent [19]

Gu

[11] Patent Number: 5,635,018

[45] Date of Patent: Jun. 3, 1997

[54] ADHESIVE TAPE SEAT

[76] Inventor: Miao-Lin Gu, 58, Ma Yuan West St., Taichung, Taiwan

[21] Appl. No.: 581,985

[22] Filed: Jan. 2, 1996

[51] Int. Cl.[6] ..... B32B 31/00

[52] U.S. Cl. ..... 156/468; 242/578

[58] Field of Search ..... 156/468, 486, 156/577; 242/578, 578.3, 599.4

[56] References Cited

U.S. PATENT DOCUMENTS

| | | | |
|---|---|---|---|
| 1,773,153 | 8/1930 | Remsnider | 242/578 |
| 3,250,482 | 5/1966 | Whitnah | 242/599.4 X |
| 5,338,384 | 8/1994 | Reichert | 156/468 X |

*Primary Examiner*—James Engel

[57] ABSTRACT

An adhesive tape seat has a main body, a push bar, a blade, a hollow adhesive tape cylinder, and a supporting strut. The supporting strut positions a rear end of the adhesive tape cylinder. The main body has fasteners at two sides of the main body. At least an outer ring which encloses the adhesive tape cylinder abuts the supporting strut. The hollow adhesive tape cylinder receives a compression spring, the first washer and a supporting rod therein. The front portion of the supporting rod is inserted through the compression spring to reach a nut. The nut covers the orifice at the front end of the adhesive tape cylinder. The rear portion of the supporting rod is inserted through the first washer, a through hole on the supporting strut and the second washer.

1 Claim, 7 Drawing Sheets

ADHESIVE TAPE SEAT

BACKGROUND OF THE INVENTION

The invention relates to an adhesive tape seat. More particularly, the invention relates to an improved adhesive tape seat for various adhesive tapes with different widths.

Most automatic packing machines have adhesive tape seats therein. Since the widths of the adhesive tapes vary from about one inch to about three inches, the cylinder on an adhesive tape seat for the adhesive tapes should be varied according to the width of the adhesive tape. Referring to FIG. 1, an adhesive tape seat comprises a main body 1, a push bar 10 and a blade 11 crisscrossing under the main body 1, and an adhesive tape cylinder 2 above the main body 1. The adhesive tape 12 crosses from the cylinder 2 to the main body 1. When a paper box moves to the area abutting the push bar 10, the adhesive tape 12 will be adhered on the paper box. When the paper box moves to the predetermined position, the blade 11 will cut the adhesive tape 12. The width of the adhesive tape 12 can be varied from one inch, one and a half inches, two inches, two and a half inches to three inches. It depends on the specifications of the paper boxes. Thus the width of the adhesive tape cylinder 2 should be varied according to the width of the adhesive tape 12. It is not convenient to change the adhesive tape cylinder 2 while the adhesive tape 12 is changed. It is an option to use the adhesive tape cylinder 2 which is wider than the adhesive tape 12. Thus the user need not change the adhesive tape cylinder 2 while the adhesive tape 12 is changed. The adhesive tape 12 which is two inches wide can cross over the adhesive tape cylinder 2 which is three inches wide. However, the adhesive tape 12 may deviate from the predetermined positions on the adhesive tape cylinder 2 and on the main body 1. The outer spring which extends from the adhesive tape cylinder 2 may clip the finger of the user while the user changes the adhesive tape cylinder 2.

SUMMARY OF THE INVENTION

An object of the invention is to provide an improved adhesive tape seat for various adhesive tapes with different widths without replacing the adhesive tape cylinder.

Another object of the invention is to provide an improved adhesive tape seat which can be positioned on an automatic packer stably.

Accordingly, an adhesive tape seat comprises a main body, a push bar and a blade disposed under the main body, a hollow adhesive tape cylinder above the main body, and a supporting strut extending upward from one side of the main body. The supporting strut positions a rear end of the adhesive tape cylinder. The adhesive tape crosses from the adhesive tape cylinder to the main body. The main body has a plurality of male fasteners at two opposite sides of the main body. At least an outer ring which encloses the adhesive tape cylinder abuts the supporting strut. The hollow adhesive tape cylinder receives a compression spring, the first washer and a supporting rod therein. The front portion of the supporting rod is inserted through the compression spring to reach a nut. The nut covers the orifice at the front end of the adhesive tape cylinder. The rear portion of the supporting rod is inserted through the first washer, a through hole on the supporting strut and the second washer. The first and the second washers abut two opposite surfaces of the supporting strut.

DETAILED DESCRIPTION OF THE INVENTION

Figure 1:
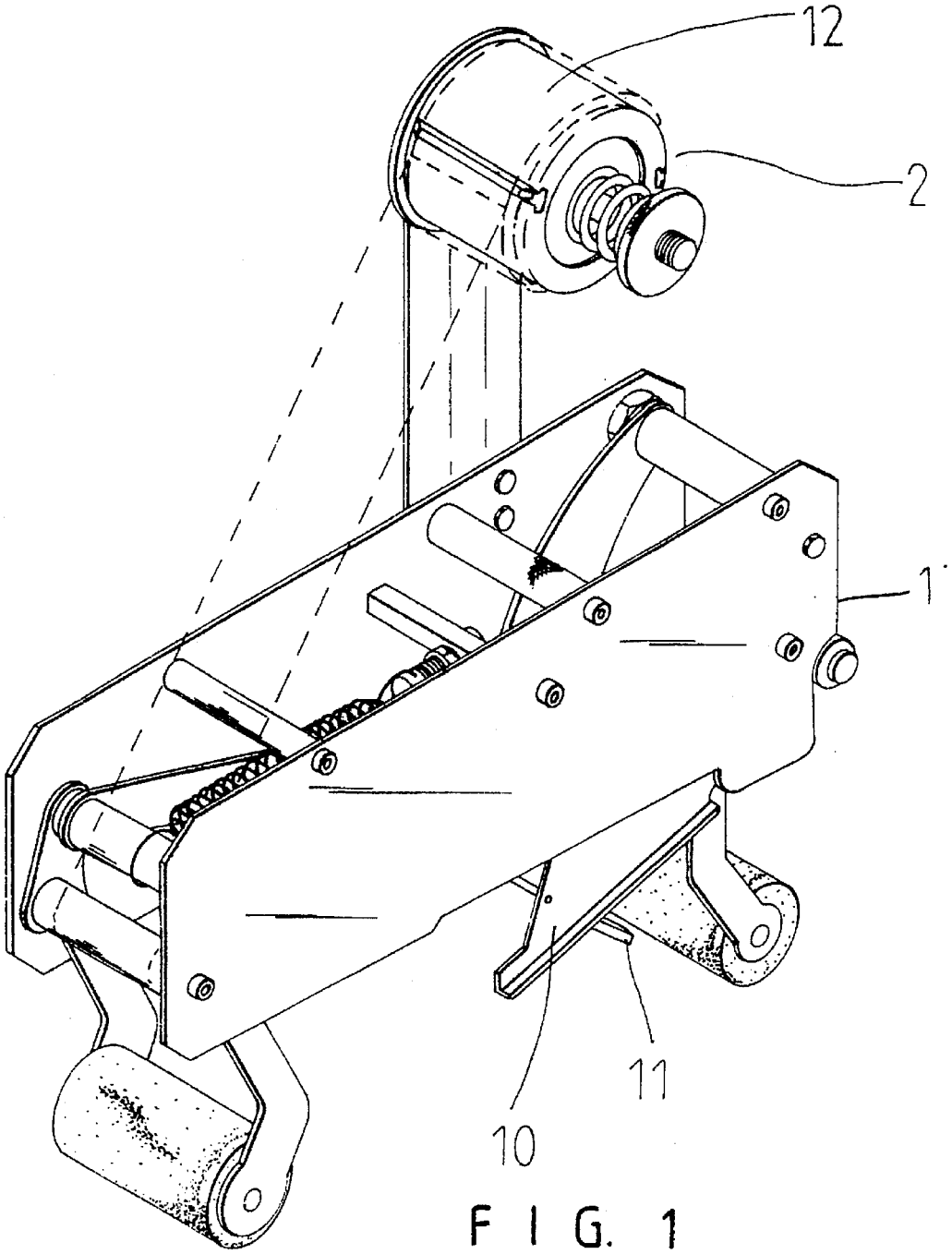
FIG. 1 PRIOR ART
FIG. 1 is a perspective assembly view of an adhesive tape seat of the prior art.
Figure 2:
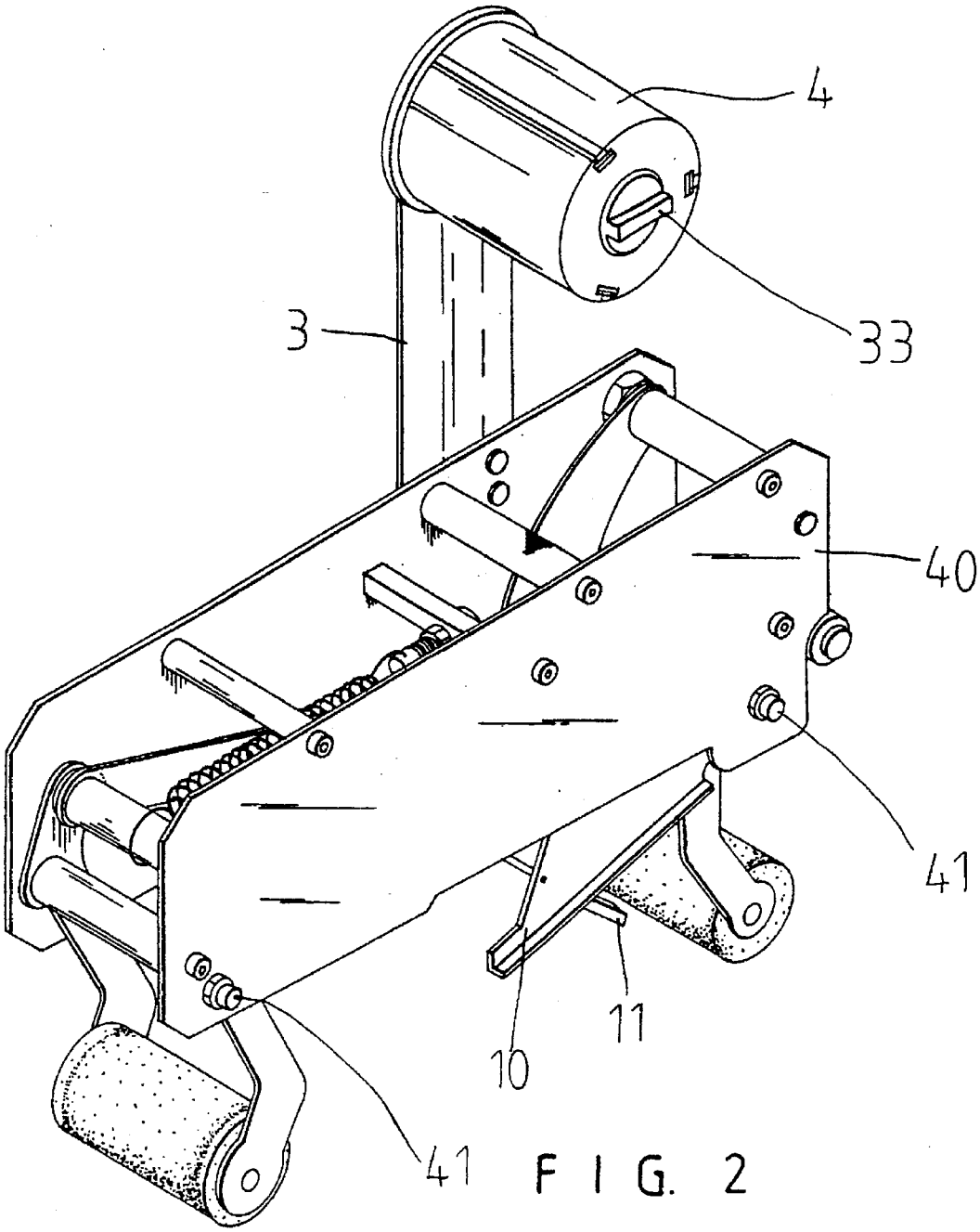
FIG. 2 is a perspective assembly view of an adhesive tape seat of a preferred embodiment without outer rings on an adhesive tape cylinder.

Referring to FIGS. 2, 3, 3A and 3B, an adhesive tape seat comprises a main body 40, a push bar 10 and a blade 11 disposed under the main body 40, a hollow adhesive tape cylinder 4 above the main body 40, and a supporting strut 3 extending upward from one side of the main body 40. The supporting strut 3 positions one end of the adhesive tape cylinder 4. The adhesive tape 6 crosses from the adhesive tape cylinder 4 to the main body 40.

Referring to FIGS. 2, 3, 4 and 4A, the main body 40 has two male fasteners 41 at one side of the main body 40 and two male fasteners 41 at the other side of the main body 40. The automatic packer 7 has female fasteners 71 which can be engaged with the corresponding male fasteners 41. The main body 40 is disposed in the automatic packer 7. Each of the two sides of the automatic packer 7 has a spring 20 connecting a round bar 22 to restrain the main body 40 in the automatic packer 7. Thus the adhesive tape seat can be positioned on an automatic packer 7 stably, and the assembly of the adhesive tape seat and the automatic packer 7 is fast and simple.

Figure 3:
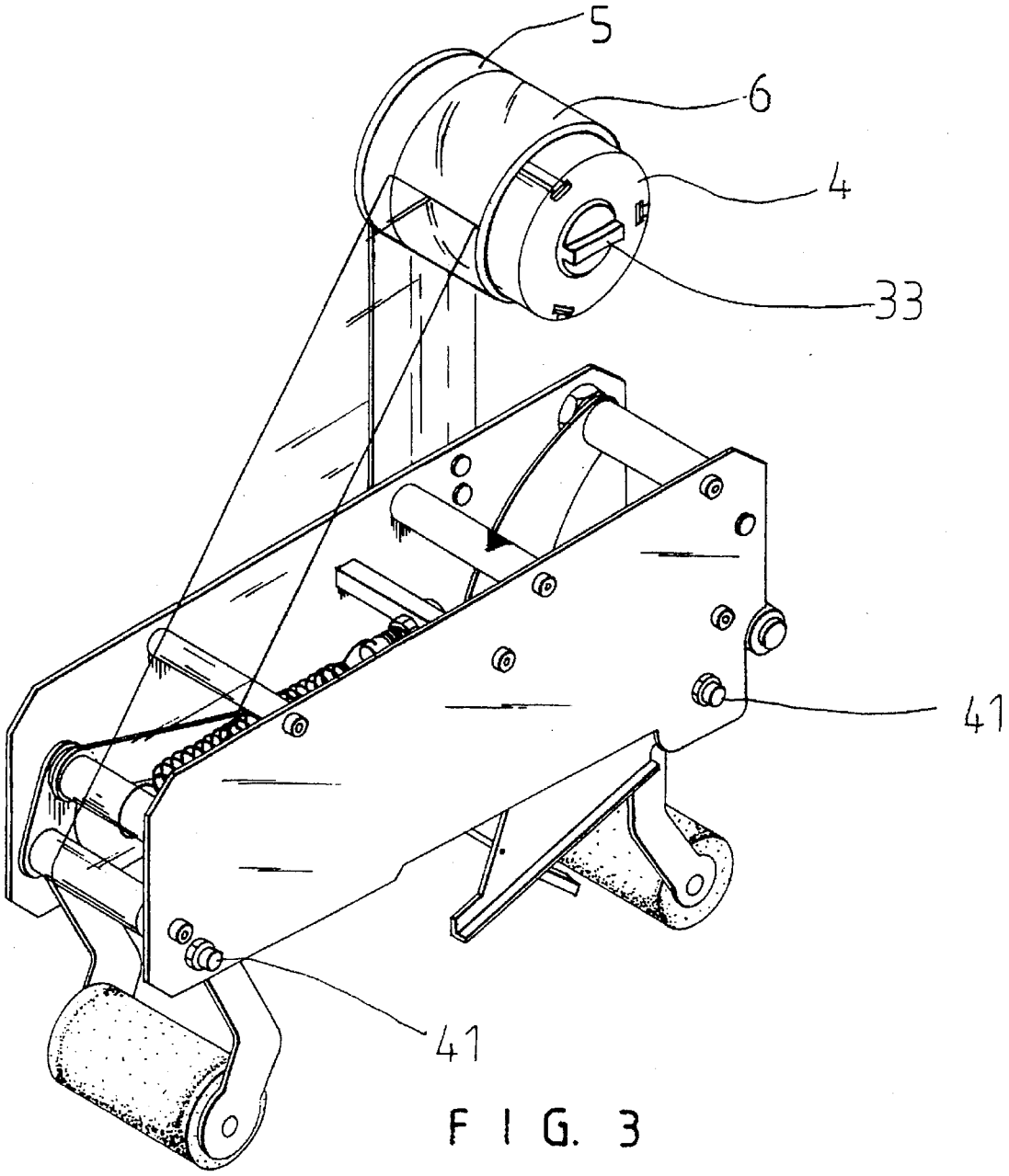
FIG. 3 is a perspective assembly view of an adhesive tape seat of a preferred embodiment with an outer ring on an adhesive tape cylinder.

Referring to FIG. 3, the width of the adhesive tape cylinder 4 is three inches. The width of the adhesive tape 6 is two and a half inches. An outer ring 5 which encloses the adhesive tape cylinder 4 abuts the supporting strut 3. The width of the outer ring 5 is a half inch. Thus the adhesive tape cylinder 4 is suitable for the adhesive tape 6.

Figure 3A:
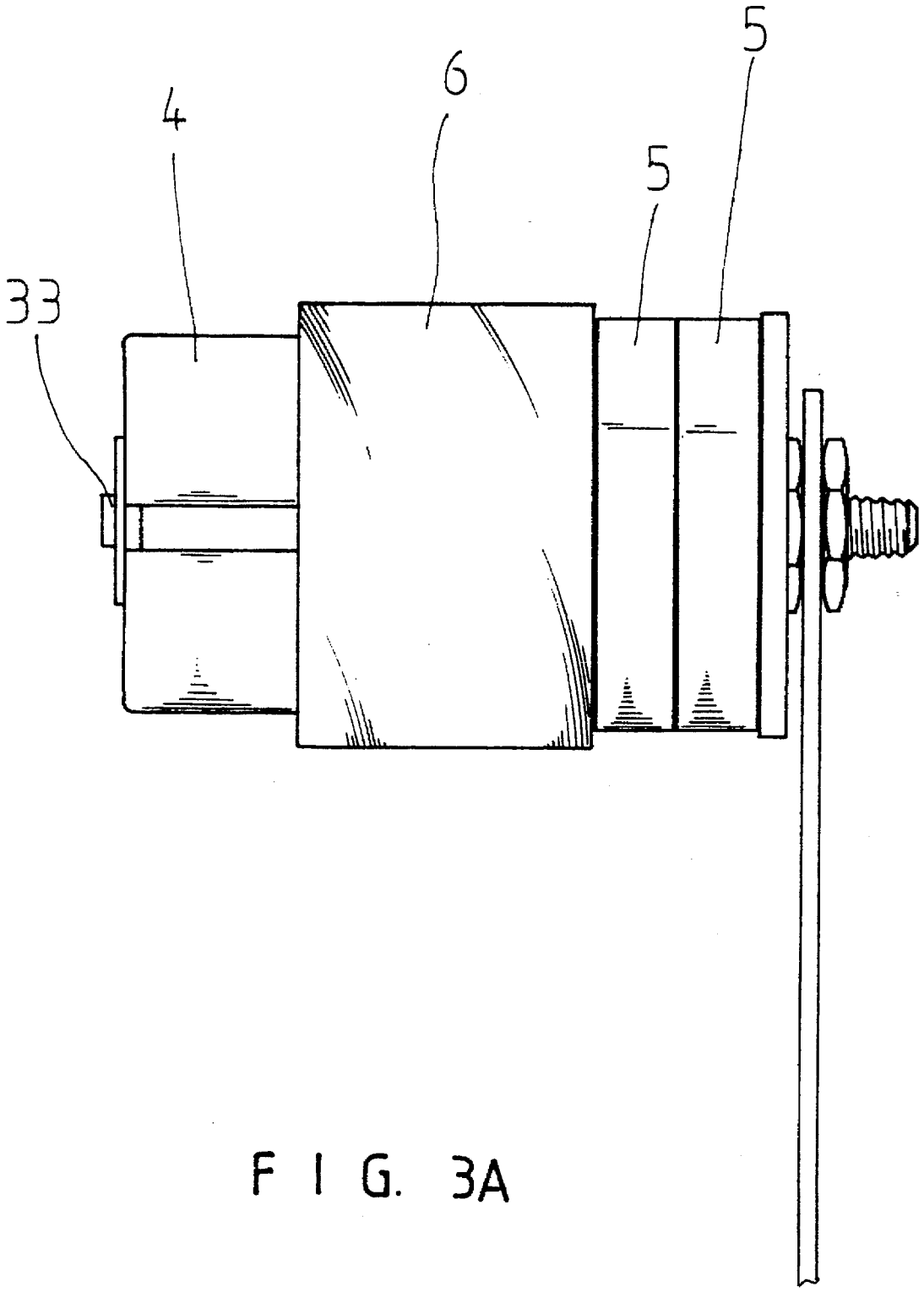
FIG. 3A is a side elevational view of an adhesive tape cylinder of a preferred embodiment with two outer rings thereon.

Referring to FIG. 3A, the width of the adhesive tape cylinder 4 is three inches. The width of the adhesive tape 6 is two inches. Two parallel outer rings 5 which encloses the adhesive tape cylinder 4 abuts the supporting strut 3. The width of the outer ring 5 is a half inch. Thus the adhesive tape cylinder 4 need not be changed even if the width of the adhesive tape 6 is smaller than that of the adhesive tape cylinder 4.

Figure 3B:
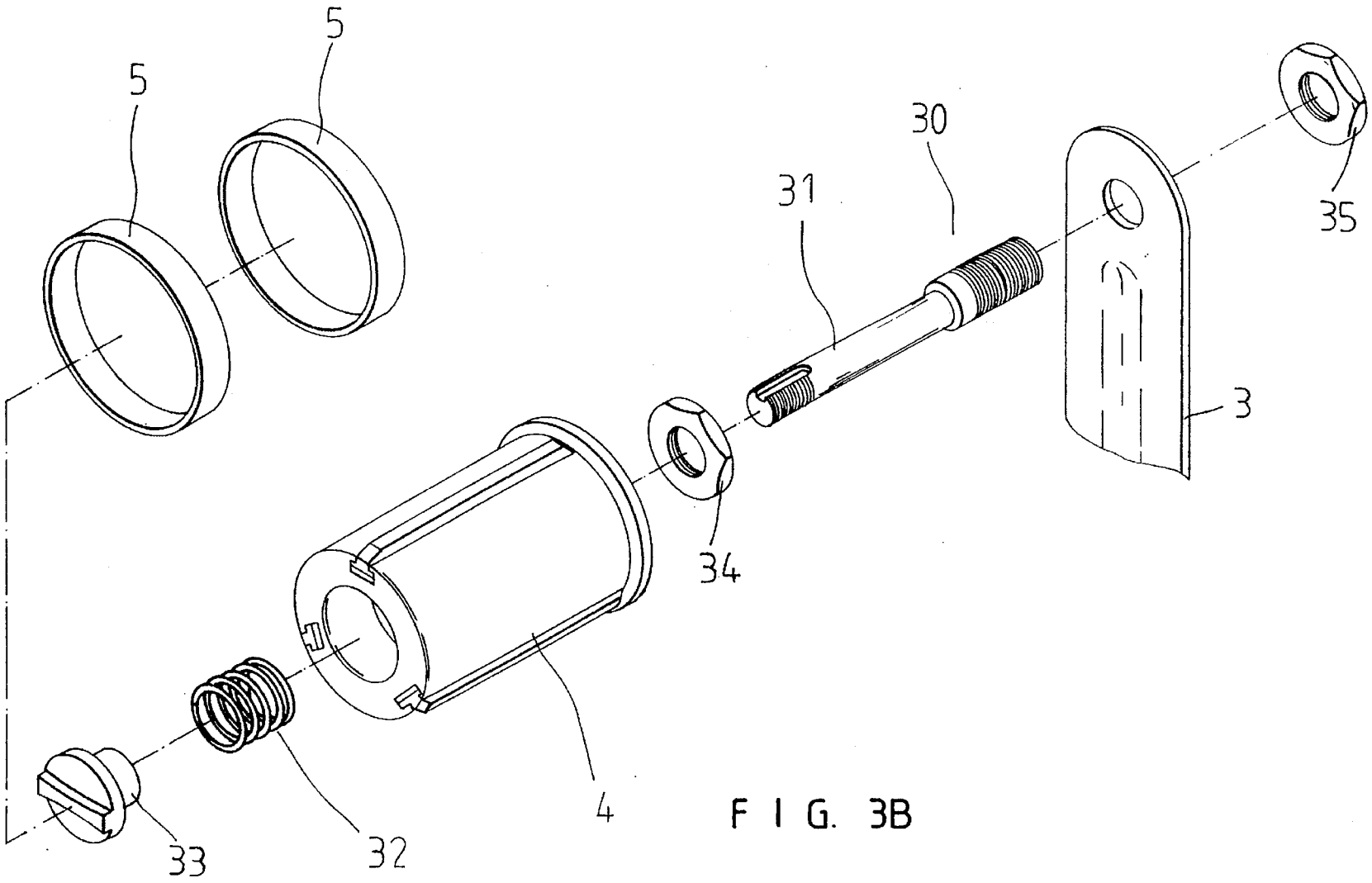
FIG. 3B is a perspective exploded view of FIG. 3A.
Figure 4:
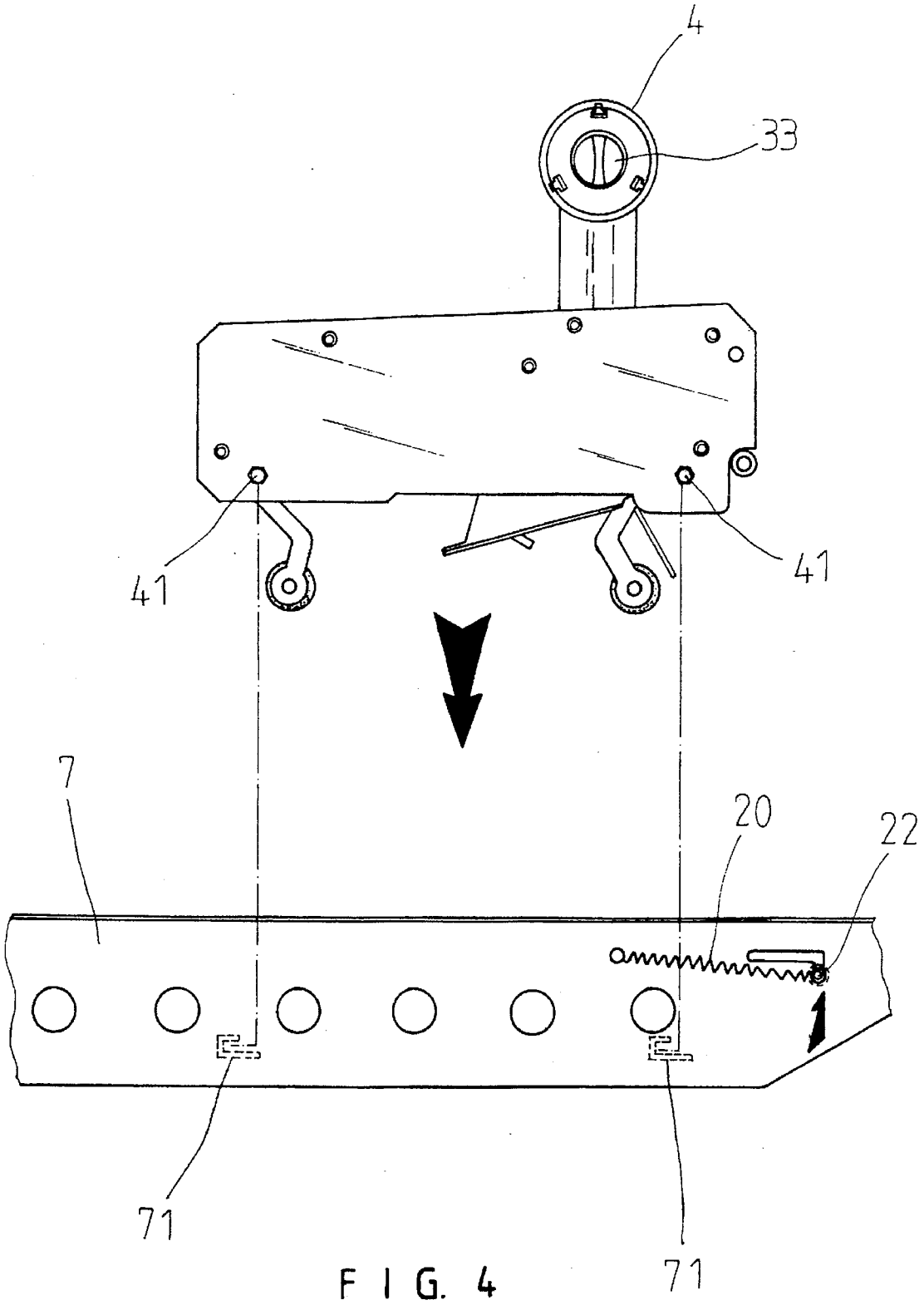
FIG. 4 is a side elevational view of an adhesive tape seat and an automatic packer while they are separated.
Figure 4A:
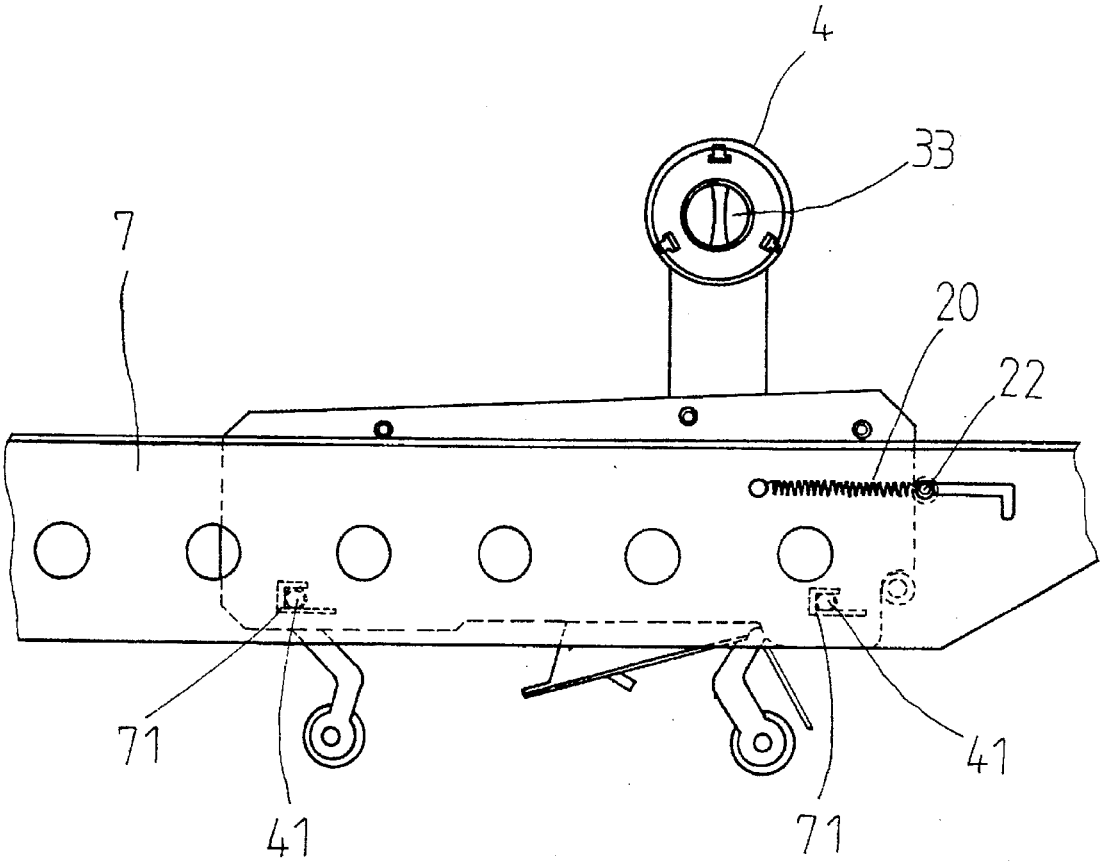
FIG. 4A is a side elevational view of an adhesive tape seat and an automatic packer while they are assembled.

Referring to FIG. 3B, the hollow adhesive tape cylinder 4 receives a compression spring 32, the first washer 34, and a supporting rod 30 therein. The front portion 31 of the supporting rod 30 is inserted through the compression spring 32 to reach a nut 33. The nut 33 covers the orifice at the front end of the adhesive tape cylinder 4. The rear portion of the supporting rod 30 is inserted through the first washer 34, a through hole on the supporting strut 3 and the second washer 35. Thus the first and the second washers 35 abut two opposite surfaces of the supporting strut 3. Since the compression spring 32 is disposed in the adhesive tape cylinder 4, the compression spring 32 will not clip the finger of the user while the user changes the outer rings 5.

The outer rings can restrain the deviation of the adhesive tapes. Thus the adhesive tape will not deviate from the predetermined positions on the adhesive tape cylinder and on the main body. The adhesive tape cylinder need not be changed according to the various width of the adhesive tape. The user can use at least one outer ring to reduce the width of the adhesive tape cylinder.

Further, the adhesive tape seat can be easily assembled in the automatic packer.

The invention is not limited to the above embodiment but various modification thereof may be made. It will be understood by those skilled in the art that various changes in form and detail may be made without departing from the scope of the invention.

I claim:

1. An adhesive tape seat comprising a main body, a push bar and a blade disposed under said main body, a hollow adhesive tape cylinder above said main body, and a supporting strut extending upward from one side of said main body, and wherein the improvement comprises:

said supporting strut positioning a rear end of said adhesive tape cylinder;

two opposite sides of said main body having a plurality of male fasteners;

at least an outer ring which encloses said adhesive tape cylinder abutting said supporting strut;

said hollow adhesive tape cylinder receiving a compression spring, a first washer and a front portion of a supporting rod therein;

said front portion of said supporting rod inserted through said compression spring to reach a nut;

said nut covering an orifice at a front end of said adhesive tape cylinder;

a rear portion of said supporting rod inserted through a first washer, a through hole on said supporting strut and a second washer; and said first and second washers abutting two opposite surfaces of said supporting strut.

* * * * *